US006520662B1

(12) United States Patent
Dedoro

(10) Patent No.: US 6,520,662 B1
(45) Date of Patent: Feb. 18, 2003

(54) PROJECTOR PARTICULARLY FOR PROJECTING LIGHT IN INFINITE COLORS, WITH HIGH-POWER BEAM

(75) Inventor: Bruno Dedoro, Castel Goffredo (IT)

(73) Assignee: Coemar S.p.A., Castel Goffredo (IT)

( * ) Notice: Subject to any disclaimer, the term of this patent is extended or adjusted under 35 U.S.C. 154(b) by 0 days.

(21) Appl. No.: 09/656,861

(22) Filed: Sep. 7, 2000

(30) Foreign Application Priority Data

May 22, 2000 (IT) ..... MI00A1131

(51) Int. Cl.[7] ..... F21V 14/00

(52) U.S. Cl. ..... 362/280; 362/281; 362/293; 362/321; 359/889

(58) Field of Search ..... 362/293, 230, 362/235, 321, 280, 281; 359/890, 892, 888, 889

(56) References Cited

U.S. PATENT DOCUMENTS

| | | | | |
|---|---|---|---|---|
| 3,107,578 A | * | 10/1963 | Engelage | 362/293 |
| 4,183,077 A | | 1/1980 | Arnold | |
| 4,719,545 A | | 1/1988 | Cano | |
| 4,800,474 A | * | 1/1989 | Bornhorst | 362/293 |
| 4,811,182 A | * | 3/1989 | Solomon | 362/321 |
| 4,893,225 A | * | 1/1990 | Solomon | 362/293 |
| 4,897,770 A | * | 1/1990 | Solomon | 362/293 |
| 5,053,934 A | * | 10/1991 | Krebs | 362/321 |
| 5,295,057 A | * | 3/1994 | Peck | 362/321 |
| 6,183,093 B1 | * | 2/2001 | Sawai | 353/31 |

FOREIGN PATENT DOCUMENTS

| | | | |
|---|---|---|---|
| DE | 36 34 156 | 4/1988 | |
| WO | WO9425797 | * 11/1994 | F21V/9/00 |
| WO | 99 40361 | 8/1999 | |

* cited by examiner

*Primary Examiner*—Sandra O'Shea
*Assistant Examiner*—Guiyoung Lee
(74) *Attorney, Agent, or Firm*—Guido Modiano; Albert Josif; Daniel O'Byrne

(57) ABSTRACT

A projector particularly for projecting light in infinite colors, comprising a pair of light sources arranged side by side and inserted in a single luminaire, a single dimmer element, a single color changer and a single diffuser element being arranged after the lamps, in order to obtain in output a light beam determined by the sum of the light beams emitted by the light sources arranged side by side.

6 Claims, 2 Drawing Sheets

PROJECTOR PARTICULARLY FOR PROJECTING LIGHT IN INFINITE COLORS, WITH HIGH-POWER BEAM

BACKGROUND OF THE INVENTION

The present invention relates to a projector particularly for projecting light in infinite colors, with high-power beam.

Conventional projectors used for example in the field of show business generally comprise a light source on whose beam a filtering element is interposed in order to produce the intended coloring.

SUMMARY OF THE INVENTION

The aim of the present invention is to provide a projector, particularly for projecting light in variable dimensions and in infinite colors, which allows to obtain a sum of power of light beams in a single luminaire.

Within the scope of this aim, an object of the present invention is to provide a projector which allows to use a single color changing system, a single dimmer and a single diffuser filter for the luminaire which has twice the power of conventional luminaires.

Another object of the present invention is to provide a projector which is compact despite being much more powerful than conventional projectors.

Another object of the present invention is to provide a projector particularly for projecting light in infinite colors which is highly reliable, relatively simple to manufacture and at competitive costs.

These and other objects which will become better apparent hereinafter are achieved by a projector particularly for projecting light in infinite colors, characterized in that it comprises a pair of light sources arranged side by side and inserted in a single luminaire, a single dimmer element, a single color changer and a single diffuser element being arranged after said lamps, in order to obtain in output a light beam determined by the sum of the light beams emitted by said light sources arranged side by side.

BRIEF DESCRIPTION OF THE DRAWINGS

Further characteristics and advantages of the present invention will become better apparent from the following detailed description of a preferred but not exclusive embodiment of the projector, illustrated only by way of non-limitative example in the accompanying drawings, wherein.

DESCRIPTION OF THE PREFERRED EMBODIMENTS

Figure 1:
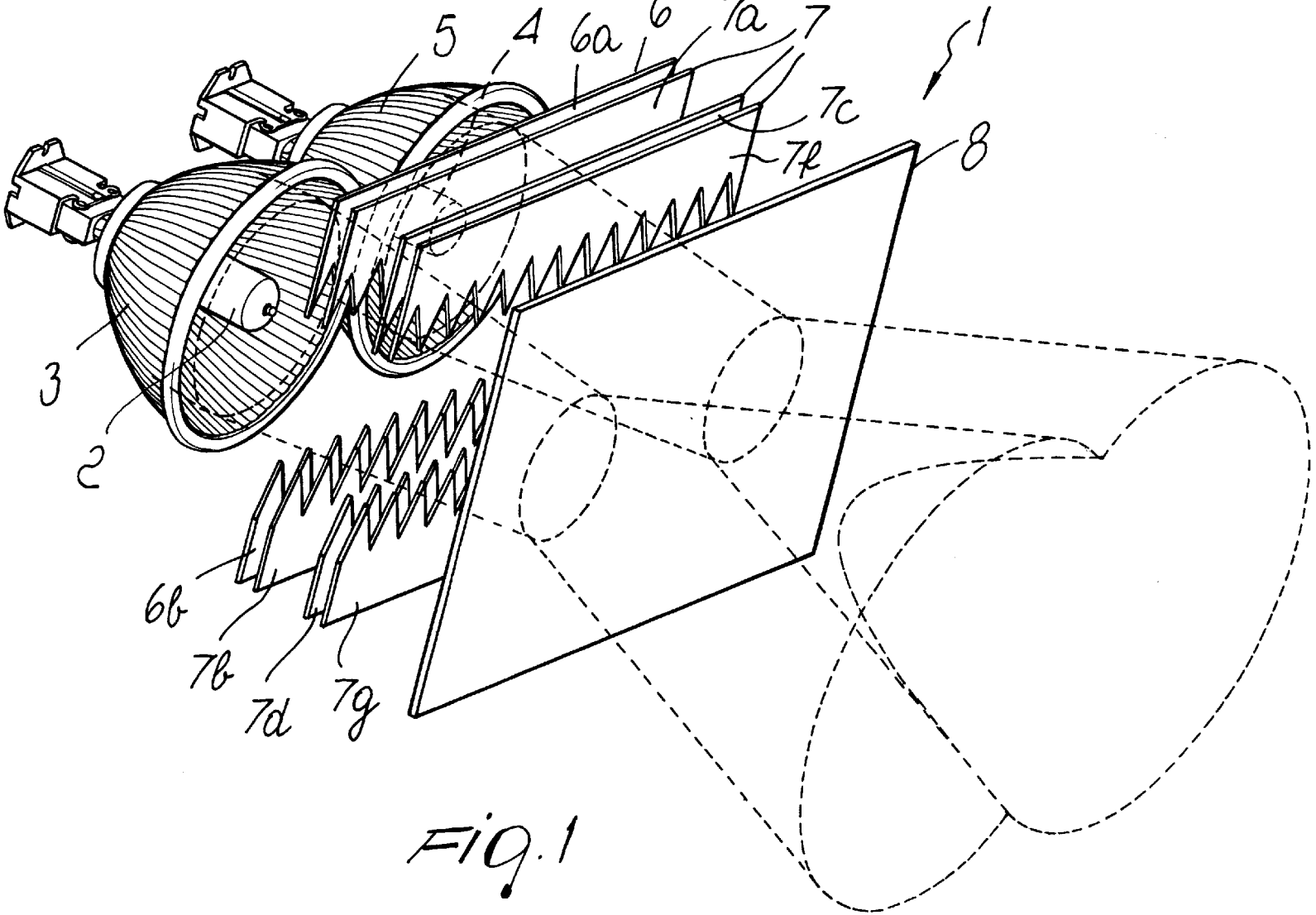
FIG. 1 is an exploded perspective view of the elements that constitute the projector according to the present invention.

With reference to the above figures, the projector according to the present invention, generally designated by the reference numeral 1, comprises two light sources arranged side by side, each provided with its own parabolic reflector. In detail, the projector comprises a first lamp 2 with a corresponding parabolic reflector 3 and a second lamp 4 with a corresponding parabolic reflector 5, arranged side by side and inserted in a single luminaire which constitutes the outer enclosure of the projector and is not shown for the sake of simplicity in the drawings.

Preferably but not exclusively, the two lamps are of the discharge type.

The two side-by-side lamps project their respective light beams through a single dimmer element 6, a color changer 7 and a diffuser filter 8. As clearly shown, a single dimmer 6, a single color changer 7 and a single diffuser filter 8 are sufficient for the pair of lamps. Substantially, the power of the light beams of the two lamps 2 and 4 is added, colored by means of the color changer 7, varied in intensity by means of the single dimmer 6 and finally rendered uniform in output by means of the single diffuser filter 8.

One of the particularities of the invention is that two lamps have been arranged side by side in a single reflecting body with a single dimmer, a single color changer and a single diffuser filter arranged sequentially in front of the light beams emitted by said lamps.

Figure 2:
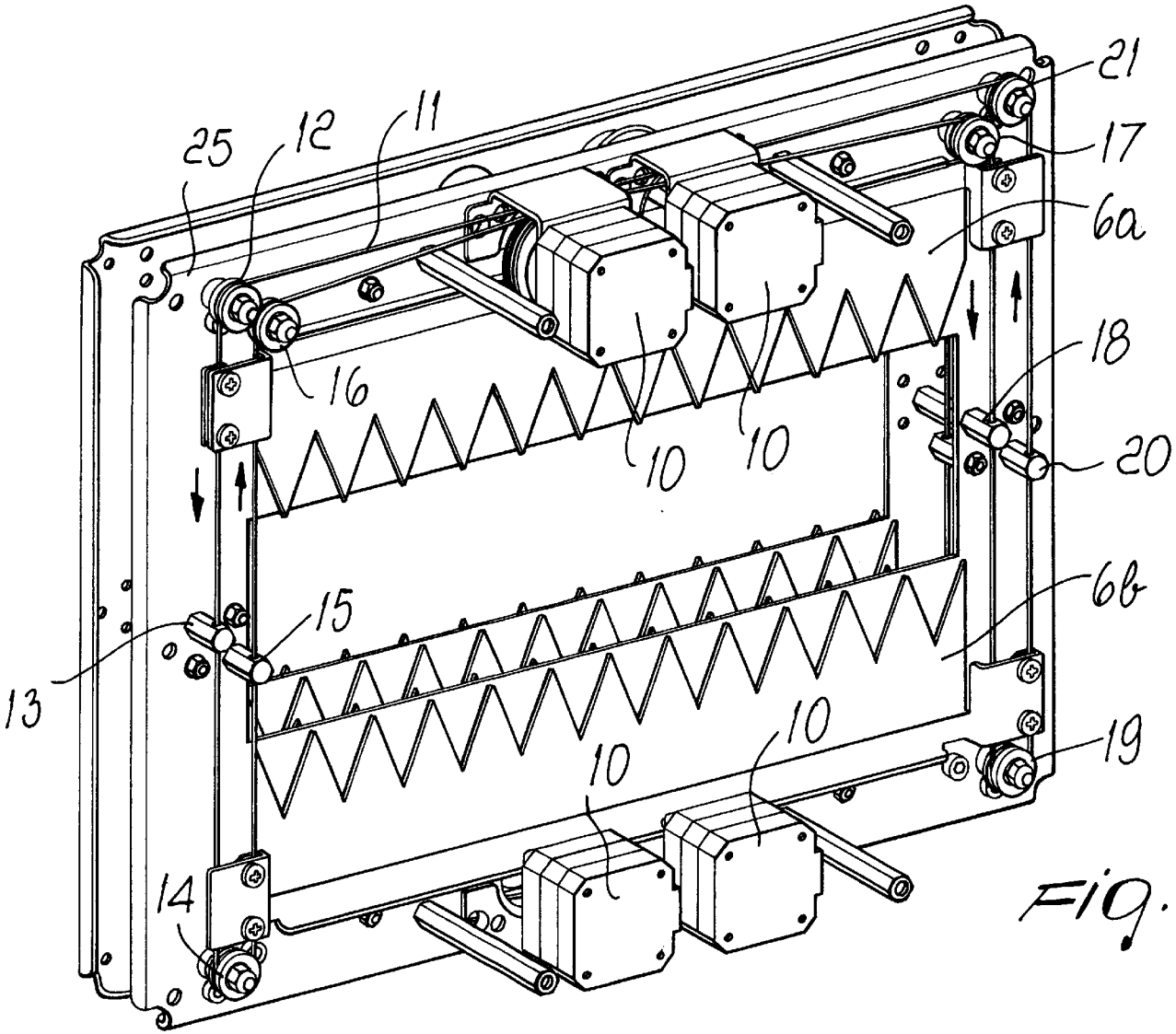
FIG. 2 is a detailed perspective view of the color changer and of the dimmer of the projector according to the invention.

FIG. 2 is a detail view of the particular configuration used for the color changer and the dimmer.

In particular, as also shown by FIG. 1, both the dimmer 6 and the color changer 7 are each constituted by a guillotine element which is composed by two elements 6a and 6b, for the dimmer, which are shaped complementarily and are substantially rectangular.

Substantially, the mutual approach of the two elements 6*a* and 6*b* and their mutual intersection allows to vary the intensity of the light beam which is emitted by each lamp and directly strikes the surface of the dimmer element 6.

The same applies to the color changer 7, which has two guillotine elements 7*a*–7*b*, 7*c*–7*d*, 7*f*–7*g* for each one of the three primary colors (cyan, magenta and yellow).

In this case also, movement along a plane which is substantially perpendicular to the axis of the light beams emitted by the lamps 2 and 4 allows to color the beams, with the elements that constitute the color changer which are also of the guillotine type, as for the dimmer element 6.

FIG. 2 is a detail view of the configuration used for vertical movement with respect to the axis of the light means of the elements that constitute the dimmer 6 and the color changer 7.

In detail, the movement of the dimmer 6 constituted by the elements 6*a* and 6*b* is illustrated for the sake of simplicity, it being understood that this also describes the movement of the elements that constitute the color changer, since it is absolutely similar.

The movement of the elements 6*a* and 6*b* is entrusted to motor means 10 which, by means of a cable 11, a first pulley 12, a first cable guiding element 13, a second pulley 14, a second cable guiding element 15, a third pulley 16, a fourth pulley 17, a third cable guiding element 18, a fifth pulley 19, a fourth cable guiding element 20 and a sixth pulley 21, move the complementary guillotine elements 6*a* and 6*b*.

In particular, the pulleys 12, 14, 16, 17, 19 and 21 are all arranged at the upper and lower corners of a supporting frame 25 along which the complementary elements 6a and 6v perform a vertical translatory motion.

Substantially, each motor means 10 designed to actuate a respective pair of guillotine elements is provided with cable and pulley means for moving in opposite directions the guillotine elements that it actuates.

With reference to FIG. 2, and assuming that the rotation of the motor means 10 used to move the guillotine elements 6*a* and 6*b* is performed counterclockwise, the cable 11 slides along the pulley 12 in the direction indicated by the arrow and then rises toward the pulley 16, descends again through the pulley 17 and rises through the pulley 19. This movement of the cable through said pulleys allows to move mutually closer or further apart the elements 6*a*, 6*b* that constitute the dimmer 6. A single motor means 10 therefore simultaneously actuates the elements 6*a* and 6*b*.

The same applies, as mentioned, to the remaining elements that constitute the color changer 7, i.e., the elements 7*a*–7*b*, 7*c*–7*d*, and 7*f*–7*g*, each pair being actuated by a single motor means 10.

In practice it has been observed that the projector according to the present invention fully achieves the intended aim and objects, since it allows to double the luminous power by arranging side by side two lamps with a single dimmer, a single color changer and a single diffuser filter which are arranged in front of the lamps. The resulting light beam is larger than in conventional projectors, since the beam of one lamp intersects the beam of the second lamp, widening it.

The projector thus obtained is extremely compact and the number of components is also reduced for an equal power of the obtainable light beams.

The projector thus conceived is susceptible of numerous modifications and variations, all of which are within the scope of the inventive concept; all the details may further be replaced with other technically equivalent elements.

In practice, the materials employed, so long as they are compatible with the specific use, as well as the dimensions and shapes, may be any according to requirements and to the state of the art.

The disclosures in Italian Patent Application No. MI2000A001131 from which this application claims priority are incorporated herein by reference.

What is claimed is:

1. A projector, particularly for projecting light in infinite colors, comprising a pair of light sources, said pair of light sources comprising a first lamp and a second lamp which are mutually arranged side by side and which are both inserted in a single luminaire, said first and second lamps being arranged side by side to emit a pair of parallel light beams, a single dimmer element, a single color changer and a single diffuser element being arranged after said first and second lamps, in order to obtain in output a light beam determined by the sum of the light beams emitted by said first and second lamps arranged side by side, said color changer comprising a color changing element for each one of the three primary colors, said dimmer element and each one of the color changing elements that constitute the color changer being constituted by two complementary elements which are adapted to be moved on a plane at right angles to the longitudinal axis of each light beam emitted by said light sources, and the pair of elements that compose said dimmer and each one of said color changing elements being constituted by two complementary shaped elements which are adapted to perform a translatory motion toward and away from each other for mutual intersection.

2. The projector according to claim 1, wherein each pair of said elements is actuated by motor means by way of cables and pulleys for the movement, in opposite directions, of each one of the elements that compose said pair of elements that compose said dimmer and said color changer.

3. A projector, particularly for projecting light in infinite colors, comprising a pair of light sources, said pair of light sources comprising a first lamp and a second lamp which are mutually arranged side by side and which are both inserted in a single luminaires a single dimmer element, a single color changer and a single diffuser element being arranged after said first and second lamps, in order to obtain in output a light beam determined by the sum of the light beams emitted by said first and second lamps arranged side by side, wherein said color changer comprises a color changing element for each one of the three primary colors.

4. The projector according to claim 3, wherein said dimmer element and each one of the color changing elements that constitute the color changer are constituted by two complementary elements which are adapted to be moved on a plane at right angles to the longitudinal axis of each light beam emitted by said light sources.

5. The projector according to claim 4, wherein the pair of complementary elements that compose said dimmer element and each one of said color changing elements is constituted by two complementary shaped elements which are adapted to perform a translatory motion toward and away from each other for mutual intersection.

6. The projector according to claim 5, comprising motor means and cables and pulleys, each pair of said complementary elements being actuated by said motor means by way of said cables and pulleys for movement, in opposite directions, of each one of the complementary elements that compose said pair of elements that compose said dimmer element and said color changer.

* * * * *